US005366085A

United States Patent [19]

Kewin

[11] Patent Number: 5,366,085

[45] Date of Patent: Nov. 22, 1994

[54] HEADER ASSEMBLY FOR PAPER ROLL PACKAGING

[76] Inventor: Daniel D. Kewin, 16, Dogwood Dr., Brantford, Ontario, Canada

[21] Appl. No.: 225,290

[22] Filed: Apr. 8, 1994

[51] Int. Cl.[5] ..... B65D 85/66

[52] U.S. Cl. ..... 206/407; 206/413

[58] Field of Search ..... 206/389, 407, 413, 414, 206/415, 416, 410

[56] References Cited

U.S. PATENT DOCUMENTS

| | | | |
|---|---|---|---|
| 1,989,182 | 1/1935 | Blake | 206/414 |
| 1,989,183 | 1/1935 | Blake | 206/414 |
| 2,474,657 | 6/1949 | Corson . | |
| 3,895,711 | 7/1975 | Hiltunen et al. | 206/413 |
| 4,505,387 | 3/1985 | Seto | 206/414 |
| 4,677,728 | 7/1987 | Straus | 206/414 X |
| 4,858,762 | 8/1989 | Kewin | 206/414 |
| 5,167,322 | 12/1992 | Lemaire . | |

*Primary Examiner*—Jacob K. Ackun, Jr.
*Attorney, Agent, or Firm*—Rogers & Scott

[57] ABSTRACT

A packaged roll of paper or other sheet material has a protective sheet of material wrapped around the circumference of the roll with overlapping longitudinally-extending edge portions secured together. The said protective sheet extends beyond the roll at opposite ends to provide projecting protective sheet portions which are crimped radially inwardly over the outer annular portions of the ends of the roll and a header assembly is located internally of the crimped over projecting protective sheet portion at at least one end of the roll. The header assembly has a header body with a generally circular periphery with a diameter substantially equal to the diameter of the roll, the header body having a circumferentially extending portion adjacent the periphery of increased thickness relative to the central portion thereof located between the crimped over protective sheet portion and the end of the roll to protect the radially outer portion of the end of the roll from damage by the crimped over projecting protective sheet portion.

6 Claims, 3 Drawing Sheets

HEADER ASSEMBLY FOR PAPER ROLL PACKAGING

Figure 1:
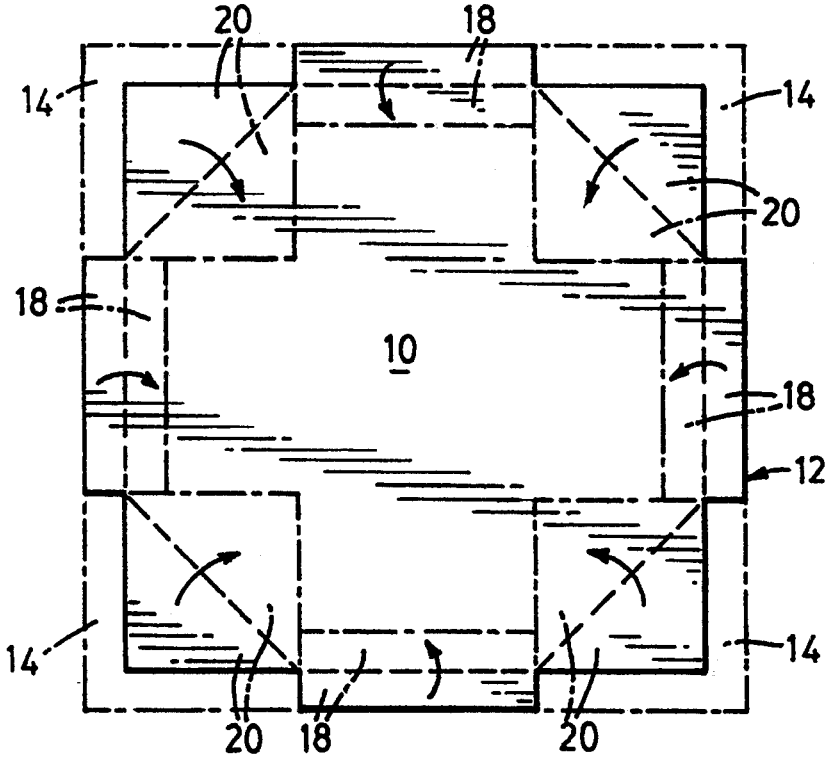

This invention relates to header assemblies for paper roll packaging.

A packaged roll of paper or other sheet material usually comprises a roll of paper or other sheet material with a protective sheet of material (i.e. a wrapper) wrapped around the circumference of the roll and having overlapping longitudinally-extending edge portions secured together, the protective sheet extending beyond the roll at opposite ends thereof to provide protecting protective sheet portions which are crimped radially inwardly over the outer annular portions of the ends of the roll. A header assembly is located internally of the crimped over projecting protective sheet portion at each end of the roll.

My prior U.S. Pat. No. 4,858,762 issued Aug. 22, 1989 (the contents of which are hereby incorporated herein by reference) discusses some of the problems caused by storing and shipping packaged rolls in a standing-on-end orientation, i.e. a vertical orientation, especially when such rolls are stacked one on top of the other, and provides an improved header construction which is designed to address such problems.

However, there is still a need for a header which deals in an improved manner with problems arising from not only storing and shipping but also use of large paper rolls.

In the past, such problems have been addressed by providing a header with increased thickness in its central area, for example as in my prior U.S. Pat. No. 4,858,762. My present invention also takes into account the previously known fact that the hardness and stability characteristics of the radially outer and inner portions of a paper roll are substantially different and that in storage, shipping and use, disproportionately large static and dynamic stresses are experienced by the radially outer portion. For example, with paper rolls with a diameter in the range of 40–50 inches, about one-third of the roll weight is in the outer five inches (radially) of the roll and this radially outer portion may become eccentric during routine handling and shipping, with the result that delivery of paper from the roll during use may be erratic. Eccentricity of the radially outer portion of a roll may be caused if the packaged roll is lowered or dropped onto a supporting surface in a vertically tilted manner such that a portion of the lower end of the packaged roll engages the supporting surface first rather than the whole end of the end face of the packaged roll. Also, highly repetitive edge loading occurs as a result of roll tilting and rotation during transit by land, for example as carriers go around curves, accelerate, decelerate or travel along bumpy surfaces. Similar stresses occur during transit by sea.

According to the present invention, a header located at the end of a roll internally of a crimped over projecting protective sheet portion comprises a header body with a generally circular periphery and a diameter substantially equal to the diameter of the roll, the header body having a circumferentially extending portion adjacent to the periphery of increased thickness relative to the central portion thereof located between the crimped over protective sheet portion and the end of the roll to protect the radially outer portion of the end of the roll from damage by the crimped over protective sheet portion.

The provision of the circumferentially extending portion of increased thickness not only reduces in an economical and technically advantageous manner the likelihood of the irregularities of the crimped over protective sheet portion causing indentations on the end of the roll, but also reduces the likelihood of storage and shipping of the roll resulting in distortion such as eccentricity of the radially outer portion of the roll. By absorbing the irregularities of the crimped over sheet portion, the circumferentially extending portion of increased thickness creates an effective barrier platform of the wrapper fold.

The header body may comprise a sheet of material with a polygonal periphery, for example an octagonal periphery, each of the sides thereof having an extension folded back at least once over the header body to provide said circumferentially extending portion of increased thickness. Alternate extensions may have a rectangular shape and extensions intermediate the rectangular extensions may have a triangular shape, the rectangular and triangular extensions being folded so as not to overlap each other.

The header body may comprise a pair of square sheets of material superposed one on the other and oriented out of alignment by 45° to provide eight projecting triangular portions, said triangular portions being folded back over the header body to provide an octagonal periphery and said circumferentially extending portion of increased thickness adjacent thereto.

The header body may comprise a disc-shaped member with said circular periphery and one of more annular portions of the same or similar material secured to the disc-shaped member adjacent to the circular periphery thereof to provide said circumferentially extending portion of increased thickness.

Figure 2:
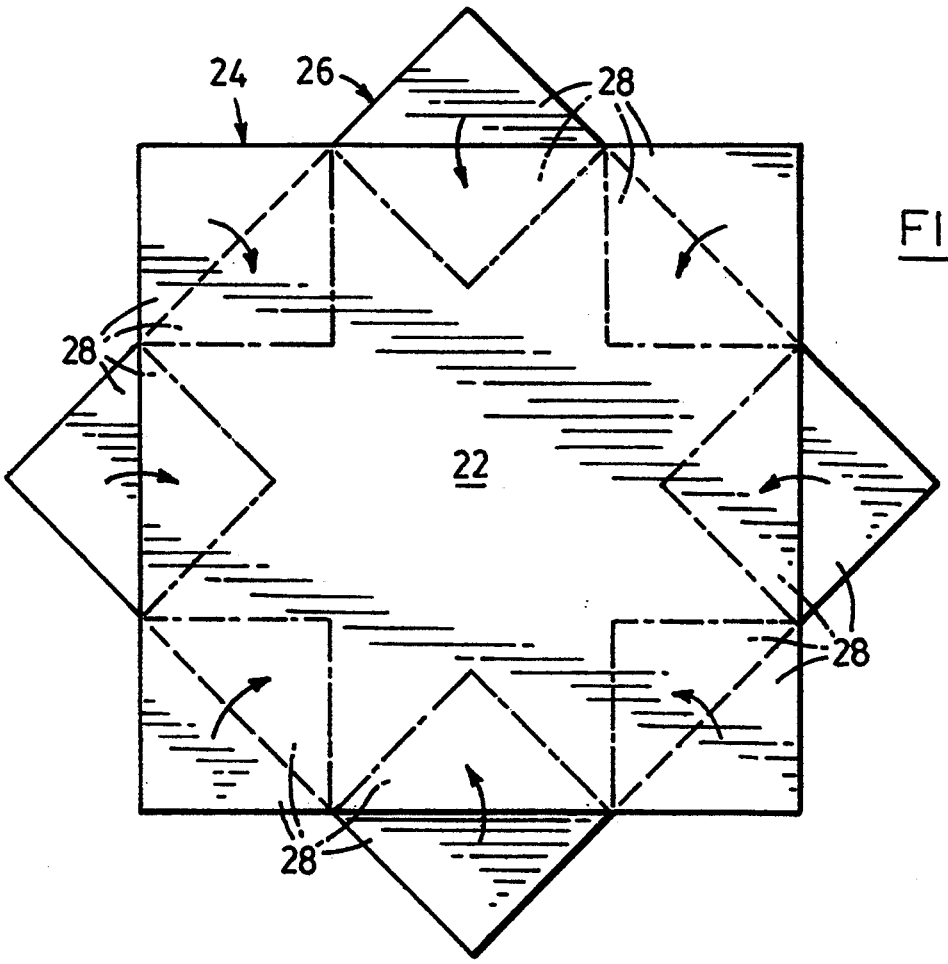
Figure 3:
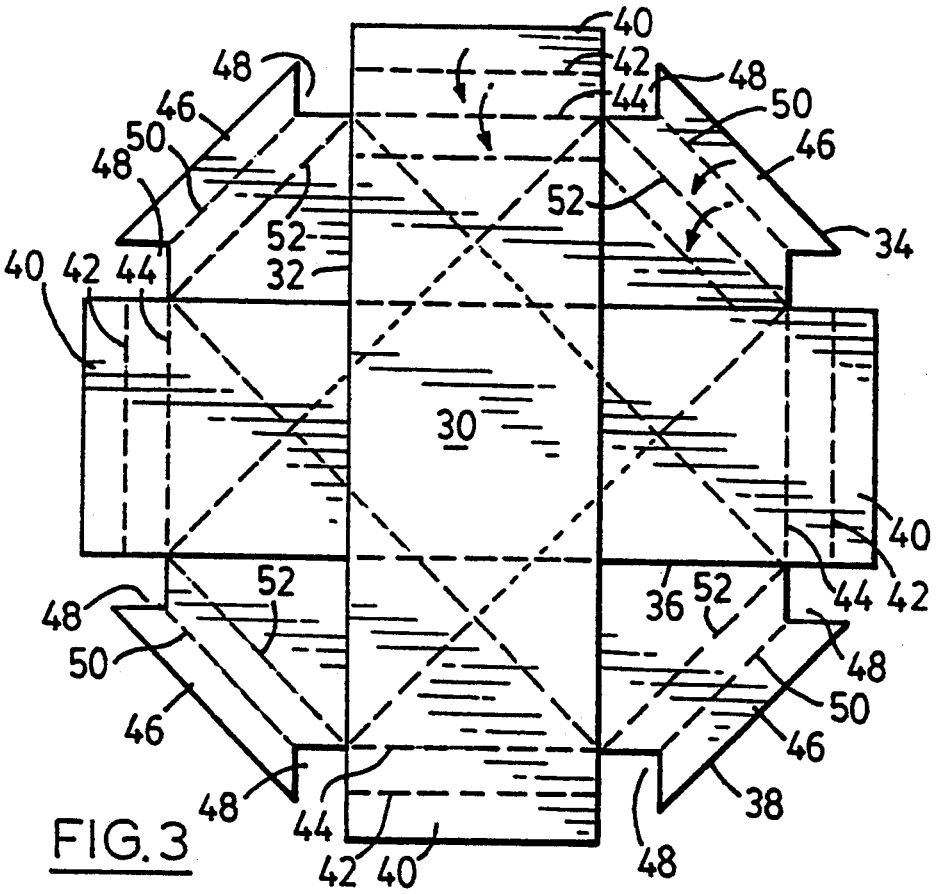
Figure 4:
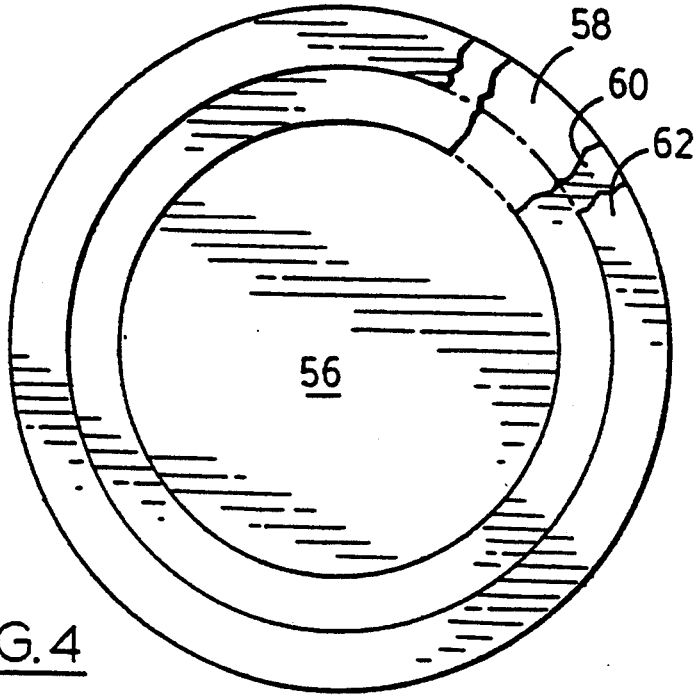
Figure 5:
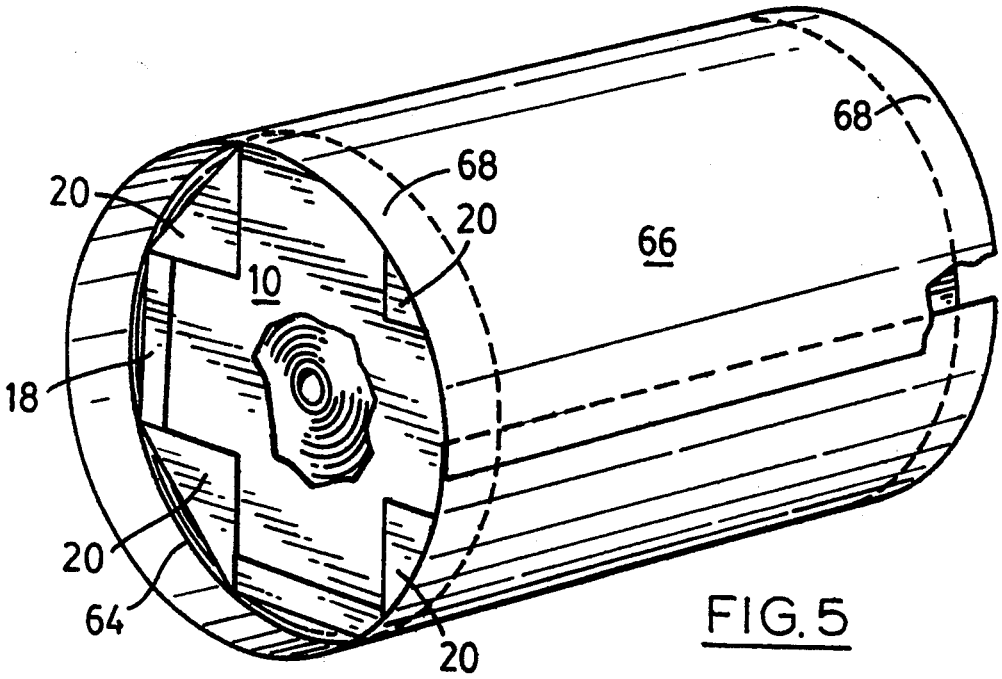
Figure 6:
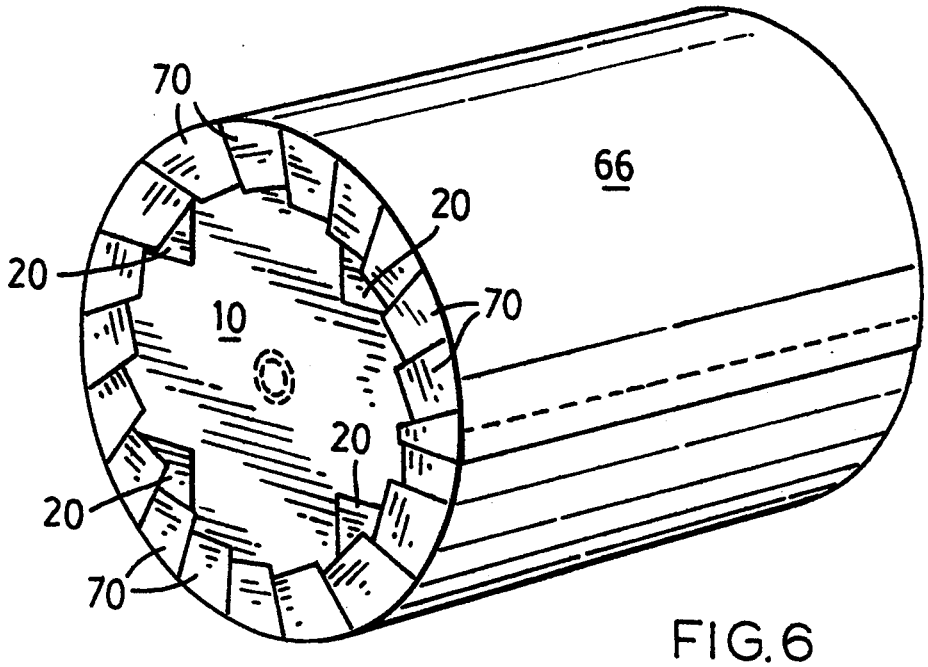
Figure 3:
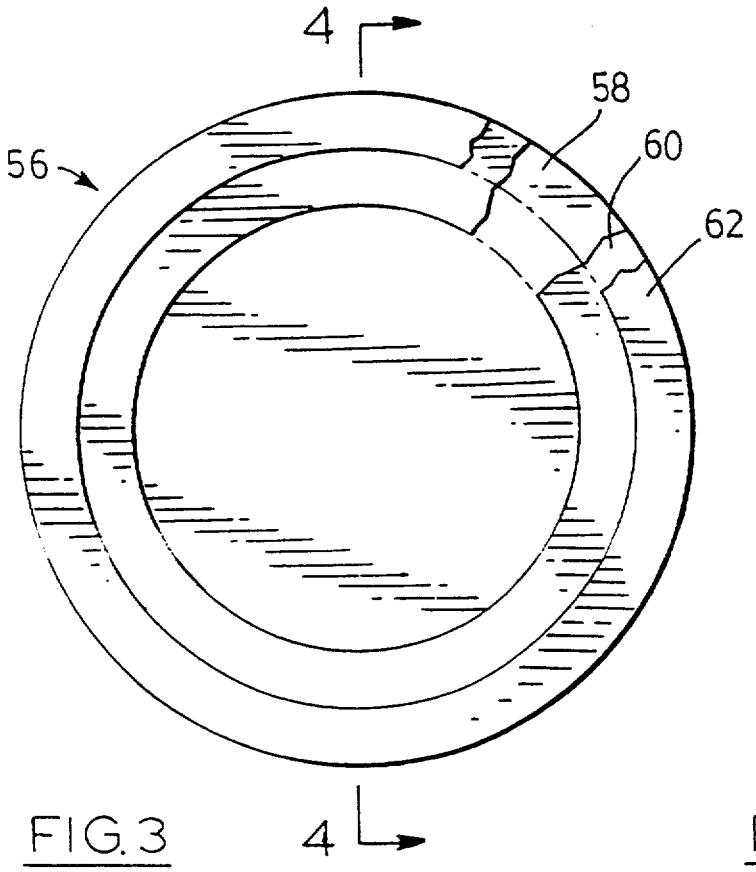
Figure 4:
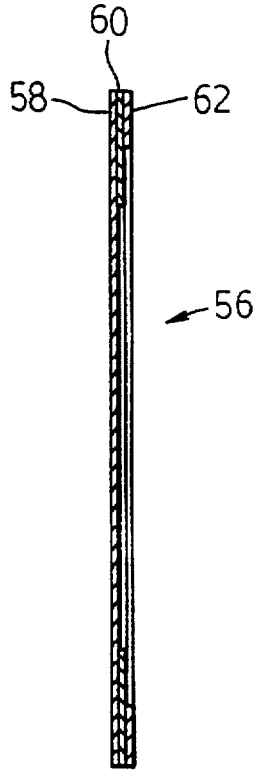

Embodiments of the invention will now be described, by way of example, with reference to the accompanying drawings, of which:

FIG. 1 is a front view of a sheet blank from which a header assembly in accordance with a first embodiment is produced, FIG. 2 is a front view of a header assembly in accordance with a second embodiment, FIG. 3 is a similar view of a header assembly in accordance with a third embodiment, FIG. 4 is a sectional view along the line 4—4 of FIG., FIG. 5 is a perspective view of a packaged roll before the projecting protective sheet portions are crimped radially inwardly over the outer annular portions of the ends of the roll, and showing a header assembly in accordance with FIG. 1 positioned adjacent one end of the roll, and FIG. 6 is a similar view to FIG. 5 but showing the projecting protective sheet portion at the end of the roll crimped radially inwardly over the outer annular portion of the header assembly.

Referring first to FIG. 1 of the drawings, a header assembly 10 is formed from a square sheet 12 of suitable board material with a thickness of about 0.025 inches by first removing four L-shaped corner portions 14, thereby leaving a header body 16 with an octagonal, i.e. generally circular, periphery with each of the eight sides thereof having an extension. Alternate extensions 18 have a rectangular shape and extensions 20 intermediate thereof have a triangular shape. Each extension 18, 20 is folded back over the header body 16 as indicated in dotted outline to form a circumferentially extending portion of double thickness adjacent the octagonal periphery. The extensions 18, 20 are folded so as not to overlap each other but to be contiguous.

In the embodiment shown in FIG. 2, a header assembly 22 is formed from a pair of square sheets 24, 26 of suitable board material each with a thickness of about 0.025 inches by first superposing one sheet 24 on the other sheet 26 and orienting the two sheets out of alignment by 45° to provide eight projecting triangular portions 28. The triangular portions 28 are then folded back over the main portions of the sheets 24, 26 as indicated in dotted outline to form a circumferentially extending portion of triple sheet thickness adjacent to the resultant octagonal periphery. The folded triangular portions 28 are secured to the main portion of sheet 24, for example by gluing, thereby also securing the two sheets 24, 26 together.

Referring now to FIG. 4, the header assembly 56 comprises a disc-shaped member of suitable board material with a thickness of about 0.025 inches, a first annular portion 60 of the same material with an external diameter equal to that of the disc-shaped member 58 secured thereto, and a second annular portion 62 of the same material but radially narrower than the first annular portion 60 secured thereto, the second annular portion 62 also having an external diameter equal to that of the disc-shaped member 58.

In use, and using the header assembly 10 of FIG. 1 as an example, the header assembly 10 is placed adjacent an end of a roll of paper 64 before the projecting protective sheet portions 68 of the protective sheet 66 (wrapper) are crimped over, as shown in FIG. 5. FIG. 6 shows the packaged roll 66 after the projecting protective sheet portion 68 have been crimped radially inwardly to form fold portions 70 over the circumferentially extending portion of increased thickness of the header assembly 10. Thus the header assembly 10 serves in an economical and technically advantageous manner to reduce damage to the radially outer portion of the roll during storage and shipping as well as minimising and in many instances eliminating the occurrence of crimp indentations on the end of a roll. The circumferentially extending portion of double thickness adjacent to the octagonal periphery of the header assembly 10 reduces the likelihood of such damage by absorbing the irregularities produced by the fold portions 70 until portion of increased thickness becomes an effective support platform. Similar comments apply to other header assemblies in accordance with the invention. An external header of any desired construction may be applied in known manner to one or both ends of the packaged roll shown in FIG. 6.

A header assembly in accordance with the invention may alternatively be produced by a molding process to produce the increased thickness adjacent the circular periphery, for example by a molding process of the general kind used to produce egg cartons.

Other embodiments of the invention will be readily apparent to a person skilled in the art from the foregoing description, the scope of the invention being defined in the appended claims.

I claim:

1. A packaged roll of paper or other sheet material comprising:

a roll of paper or other sheet material, a protective sheet of material wrapped around the circumference of the roll and having overlapping longitudinally-extending edge portions secured together, said protective sheet extending beyond the roll at opposite ends thereof to provide projecting protective sheet portions, the projecting portion of the protective sheet at each end being crimped radially inwardly over the outer annular portion of the end of the roll, and a header assembly at at least one end of the roll located internally of the crimped over projecting protective sheet portion, said header assembly comprising a header body with a generally circular periphery with a diameter substantially equal to the diameter of the roll, said header body having a circumferentially extending portion adjacent the periphery of increased thickness relative to the central portion thereof located between the crimped over protective sheet portion and the end of the roll to protect the radially outer portion of the end of the roll from damage by the crimped over projecting protective sheet portion.

2. A packaged roll according to claim 1 wherein the header body comprises a sheet of material with a polygonal periphery, each of the sides thereof having an extension folded back at least once over the header body to provide said circumferentially extending portion of increased thickness.

3. A packaged roll according to claim 2 wherein the sheet of material has an octagonal periphery.

4. A packaged roll according to claim 3 wherein alternate extensions have a rectangular shape and extensions intermediate the rectangular extensions are of triangular shape, said rectangular and triangular extensions being folded so as not to overlap each other.

5. A packaged roll according to claim 1 wherein the header body comprises a pair of square sheets of material superposed one on the other and oriented out of alignment by 45° to provide eight projecting triangular portions, said triangular portions being folded back over the header body to provide an octagonal periphery and said circumferentially extending portion of increased thickness adjacent thereto.

6. A packaged roll according to claim 1 wherein the header body comprises a disc-shaped member having said circular periphery and one or more annular portions of the same or similar material secured to the disc-shaped member adjacent to the circular periphery thereof to provide said circumferentially extending portion of increased thickness.

* * * * *

UNITED STATES PATENT AND TRADEMARK OFFICE

CERTIFICATE OF CORRECTION

PATENT NO. : 5,366,085

DATED : November 22, 1994

INVENTOR(S) : Daniel D. Kewin

It is certified that error appears in the above-indentified patent and that said Letters Patent is hereby corrected as shown below:

In the drawings, sheet 2 consisting of Figs. 3 and 4 should be deleted, to be replaced with the corrected Figs. 3 and 4, as shown on the attached page.

Signed and Sealed this

Thirteenth Day of June, 1995

*Attest:*

Bruce Lehman

BRUCE LEHMAN

*Attesting Officer*

*Commissioner of Patents and Trademarks*